United States Patent [19]

Hirayama et al.

[11] 4,370,053

[45] Jan. 25, 1983

[54] DEVELOPER SUPPLY DEVICE

[75] Inventors: Kazuhiro Hirayama, Yokohama; Michio Ito, Hachiohji, both of Japan

[73] Assignee: Canon Kabushiki Kaisha, Tokyo, Japan

[21] Appl. No.: 224,802

[22] Filed: Jan. 13, 1981

[30] Foreign Application Priority Data

Jan. 19, 1980 [JP] Japan ..... 55-4992

[51] Int. Cl.[3] ..... G03G 15/00

[52] U.S. Cl. ..... 355/14 D; 118/689; 118/691; 222/DIG. 1; 355/3 DD

[58] Field of Search ..... 355/14 D, 3 DD; 118/668, 688, 689, 691; 222/DIG. 1; 430/30, 120

[56] References Cited

U.S. PATENT DOCUMENTS

| | | | |
|---|---|---|---|
| 3,233,781 | 2/1966 | Grubbs | 355/14 D |
| 4,171,902 | 10/1979 | Imai et al. | 355/3 R |
| 4,226,525 | 10/1980 | Sakamoto et al. | 355/3 DD |
| 4,241,696 | 12/1980 | Huzll | 355/3 DD |
| 4,256,402 | 3/1981 | Nishikawa | 355/3 DD |
| 4,257,348 | 3/1981 | Prohaska | 355/3 DD |
| 4,270,487 | 6/1981 | Terashima et al. | 355/3 DD |
| 4,272,182 | 6/1981 | Abe et al. | 355/3 DD |
| 4,273,843 | 6/1981 | Fujita et al. | 355/3 DD |
| 4,276,854 | 7/1981 | Fujita et al. | 355/3 DD |
| 4,279,498 | 7/1981 | Eda et al. | 355/3 DD |

*Primary Examiner*—R. L. Moses

*Attorney, Agent, or Firm*—Fitzpatrick, Cella, Harper & Scinto

[57] ABSTRACT

This specification discloses a developer supply device which supplies separately toner and carrier of a two-component developer and in which supply of toner is controlled in accordance with the variation in volume of the developer within a developing device and supply of carrier is controlled in accordance with the variation in density of the toner.

10 Claims, 10 Drawing Figures

DEVELOPER SUPPLY DEVICE

BACKGROUND OF THE INVENTION

1. Field of the Invention

This invention relates to a developer supply device for maintaining constant the developing effect of a developer for electrophotography having a toner and carrier.

2. Description of the Prior Art

Generally, in the developing method in dry type electrophotography or electrostatic recording, use is made of a two-component developer consisting of a mixture of toner and carrier. It is well known that the weight admixture ratio of toner and carrier in such a developer is a very important factor from the viewpoint of the developing effect. When the proportion of toner to carrier (hereinafter simply referred to as the toner density) is low, namely, when the density of the developer is low, the density of the developed image becomes thin. Conversely, when the proportion of toner is too high, the density of the developed image becomes too thick and also fog is increased.

Accordingly, in order that images of preferable color tone may be continuously obtained, it is necessary to render the density of the developer into a proper level and moreover to maintain the level constant always during development. To control the toner density constant, there are:

(1) a method in which a toner and carrier are made to differ in color and by utilizing the fact that when the toner density varies with the consumption of toner, the color of the developer which is a mixture of toner and carrier changes, the color change is optically detected so that a toner supply mechanism is controlled in accordance with that change, thereby maintaining the toner density constant;

(2) a method in which a portion to be experimentally developed (for example, to be developed by applying a voltage to a conductor of a color different from the color of the toner) is provided and the reflection density of the developed portion is optically detected so that a toner supply mechanism is controlled in accordance with the variation in the reflection density to thereby maintain the toner density constant (see, for example, U.S. Pat. No. 3,348,521);

(3) a method in which a transparent conductor such as a Nesa glass electrode or the like is used to effect experimental development as in the method (2) above and the transmission density of the developed portion is optically detected so that a toner supply mechanism is controlled in accordance with the variation in the transmission density to thereby maintain the toner density constant; and (4) a method in which the difference in magnetic permeability between the toner and carrier is utilized to detect any variation in magnetic permeability of the developer so that a toner supply mechanism is controlled in accordance with the variation to thereby maintain the toner density constant (see, for example, U.S. Pat. No. 3,698,926).

However, in the conventional developer supply devices, although the developer handled thereby has been a two-component developer, the developer supplied as a replenishing agent has been toner alone or a developer consisting of toner and carrier mixed therewith at a very small proportion. The conventional developer supply devices have not been such that the supply of carrier is effected separately from the supply of toner. Accordingly, there have been adopted means whereby toner alone or toner with a small amount of carrier mixed therewith is supplied to compensate for the reduction in toner density which takes place in accordance with toner consumption, and this has led to a disadvantage that even if the toner density can be maintained substantially constant, the amount (volume) of the developer (mixture of toner and carrier) within the developing device varies. Also, in the conventional developer supply devices, the supply of carrier is not independently effected and therefore, when toner alone is supplied, a variation in volume of the developer has resulted from the consumption of carrier (actually, carrier is also consumed little by little), and in the case of the supply of toner with carrier mixed therewith, there has been a disadvantage that if a balance with the consumed carrier is not kept, a variation in volume of the developer may also occur to vary the image density.

Such a variation in volume of the developer within the developing device cannot be visually confirmed because the developing device is usually mounted deep in the dark interior of an electrophotographic apparatus body and heretofore, it has been difficult to judge such variation by referring to the density of the image on the resultant copy paper or to detect it only when the developer has become less than a predetermined amount. Accordingly, the fact that it cannot be easily determined if there is any change to increase or decrease the amount of the developer from a preferable amount has necessarily resulted in adverse effects such instability of the image density attributable to the variation in amount of the developer, increased fog, reduced sharpness of the image portion, irregularity of development etc., and has also adversely affected the stirring and conveyance of the developer.

Now, the variation in amount of the developer within the developing device will be positively explained. FIGS. 1 and 2 of the accompanying drawings show consumption data, actually measured of toner and carrier by the magnet developing method using magnetic carrier (iron powder) and toner as a two-component developer.

FIG. 1 shows the toner consumption by a printed image, namely, a printed image in which the proportion of the area occupied by the black print of the toner to the white ground of recording paper differs. The ordinate represents the weight of toner consumed per sheet of A4 size recording paper. The abscissa represents the proportion of the area of the print portion (the portion to which toner is to adhere) to the area of the recording paper (in this case, A4=210 mm×297 mm). The term 100% used herein means a solid black image.

FIG. 2 shows the carrier consumption resulting from the difference between printed images. The ordinate represents the weight of carrier consumed per sheet of A4 size recording paper. That is, the ordinate shows the measured amount of carrier on a developed member (in the present measurement example, a photosensitive drum). The abscissa, as in FIG. 1, represents the proportion of the area of the print portion to the area of the recording paper.

Part of the toner or carrier of the amount shown in FIGS. 1 and 2 is transferred to the recording paper and the remainder is collected by a cleaning device. That is, these amounts of toner and carrier show the amount brought out of the developing device.

As can be seen from FIGS. 1 and 2, the toner consumption varies in accordance with the area of the print portion of the printed image. On the other hand, the carrier consumption is not varied as much. This shows that the rates of consumption of toner and carrier are varied by the printed image. In spite of the fact that the proportion of toner and carrier consumed thus differs depending on the printed image, an attempt to maintain the toner density constant by one kind of replenishing agent (toner alone or a replenishing developer consisting of toner with carrier mixed therewith at a certain predetermined ratio) as has heretofore been done would necessarily result in a variation in amount of the developer within the developing device.

A method of detecting any variation in volume of the developer within the developing device and supplying toner to maintain the volume of the developer constant is heretofore known from Japanese Laid-open Patent Applications Nos. 19459/1975 and 78343/1976. This method is effective to maintain the density of the toner in the developer constant for a relatively short time (the order of 100,000 to 200,000 sheets of A4 size recording paper). However, this method is based on the premise that the amount of carrier brought out of the developing device is zero or constant and therefore, in a case where the developing device is used for such a long time as to exceed 500,000 sheets of A4 size recording paper, the density of the toner in the developer within the developing device comes to greatly differ from its initial value and this will remarkably affect the output images. Particularly, in an electrophotographic apparatus utilizing a laser beam, image formation is effected continuously and for example, an average of 1,000,000 sheets of A4 size recording paper is produced per month. This will result in a remarkable decrease not only in toner but also in carrier.

SUMMARY OF THE INVENTION

It is an object of the present invention to eliminate the above-noted disadvantages peculiar to the prior art and to provide a novel developer supply device which maintains the developing effect constant.

It is another object of the present invention to provide a developer supply device which supplies separately toner and carrier to a developing device.

It is still another object of the present invention to provide a developer supply device which supplies toner to the developing device by detecting any variation in volume of the developer within the developing device.

It is yet still another object of the present invention to provide a developer supply device which supplies carrier by detecting the image density.

It is a further object of the present invention to provide an electrophotographic apparatus which has a toner supply device and a carrier supply device and which effects image formation by the use of a laser beam.

The present invention consists in a developer supply device which has a toner supply means for supplying toner to the developing device and carrier supply means for supplying carrier to the developing device. The present invention further consists in a developer supply device which supplies toner to the developing device by detecting any variation in volume of the developer within the developing device and supplies carrier to the developing device by detecting the image density.

The above and other objects and features of the present invention will become more apparent from the following detailed description when read in conjunction with the accompanying drawings.

DESCRIPTION OF THE PREFERRED EMBODIMENT

An embodiment of the developer supply device according to the present invention will hereinafter be described with reference to the drawings.

Figure 1:
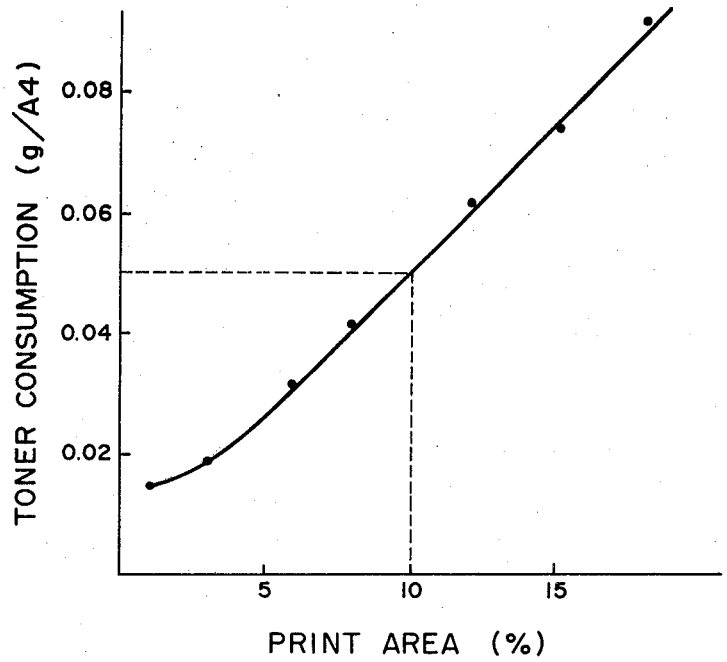
FIG. 1 is a graph showing the relation between the print area ratio of A4 size recording paper and toner consumption.
Figure 2:
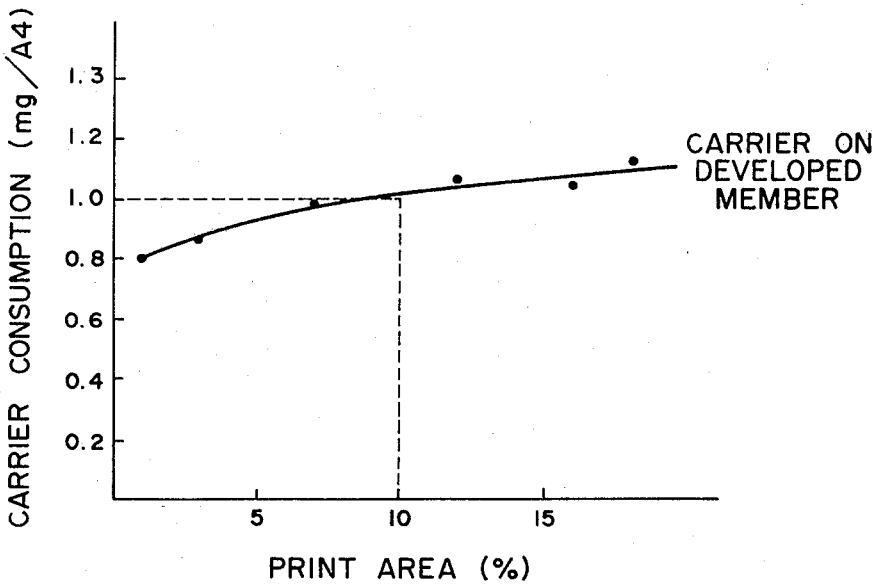
FIG. 2 is a graph showing the relation between the print area ratio of A4 size recording paper and carrier consumption.
Figure 3:
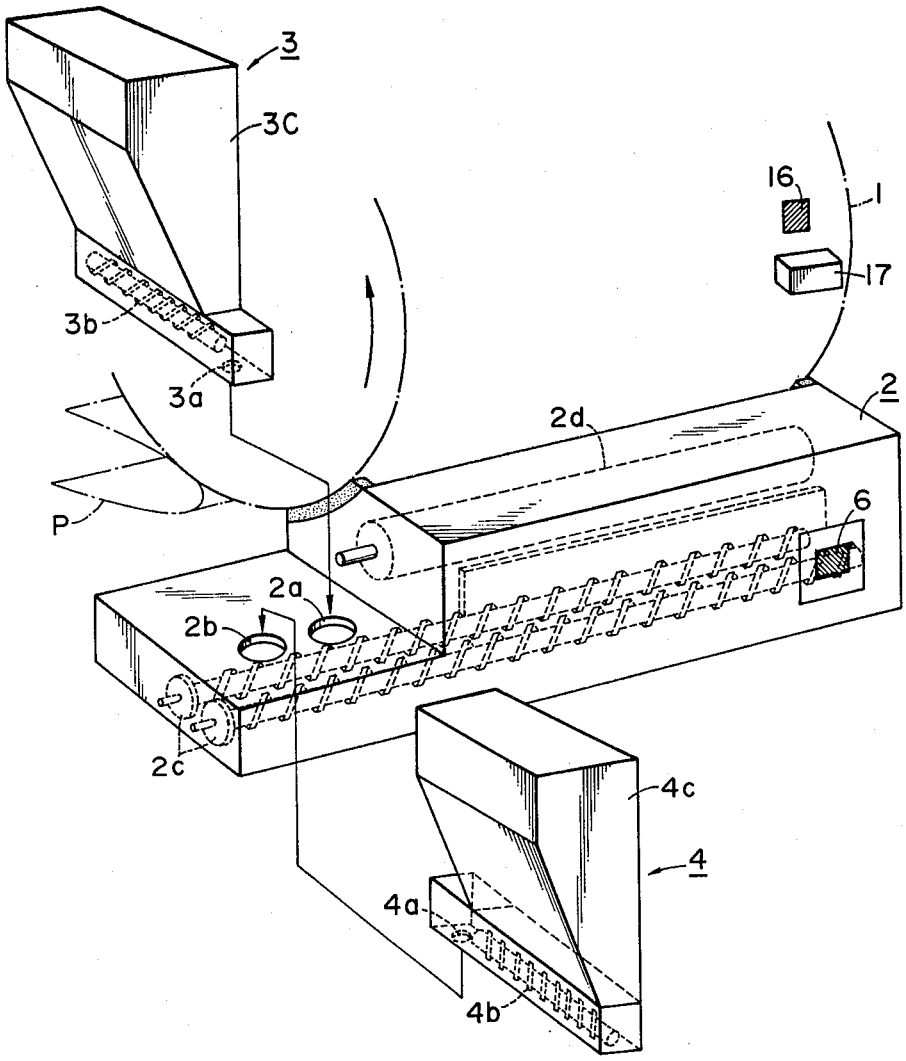
FIG. 3 is a perspective view showing the entire construction of the developer supply device according to the present invention.
Figure 4:
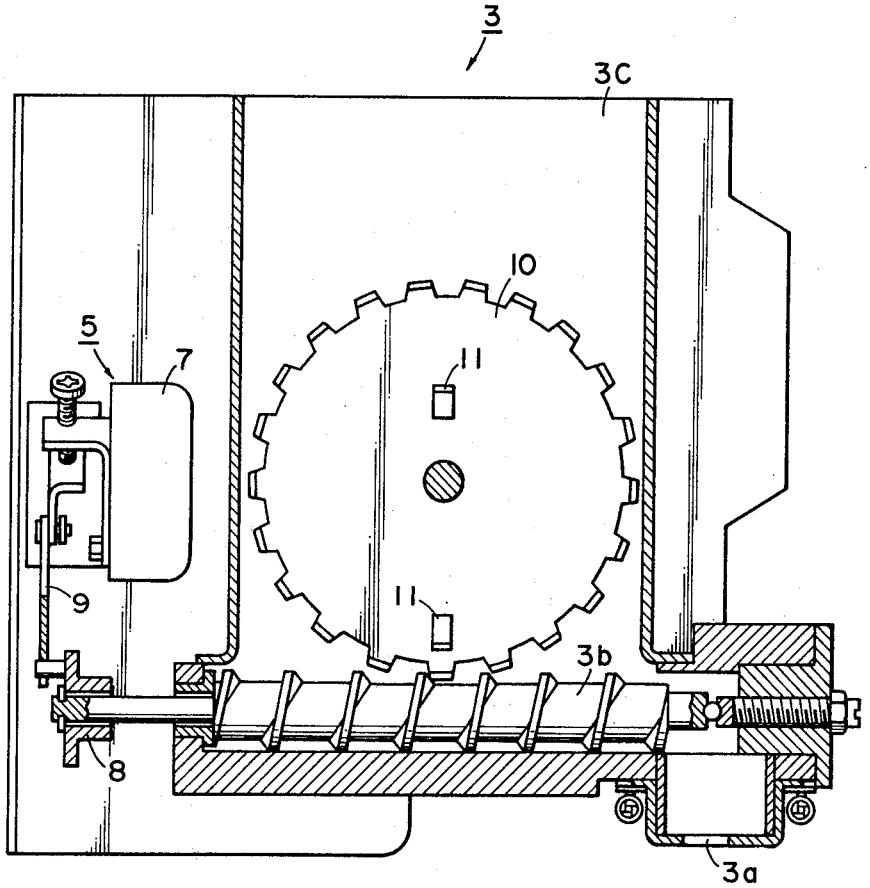
FIG. 4 is a cross-sectional view of a toner supply device.
Figure 5:
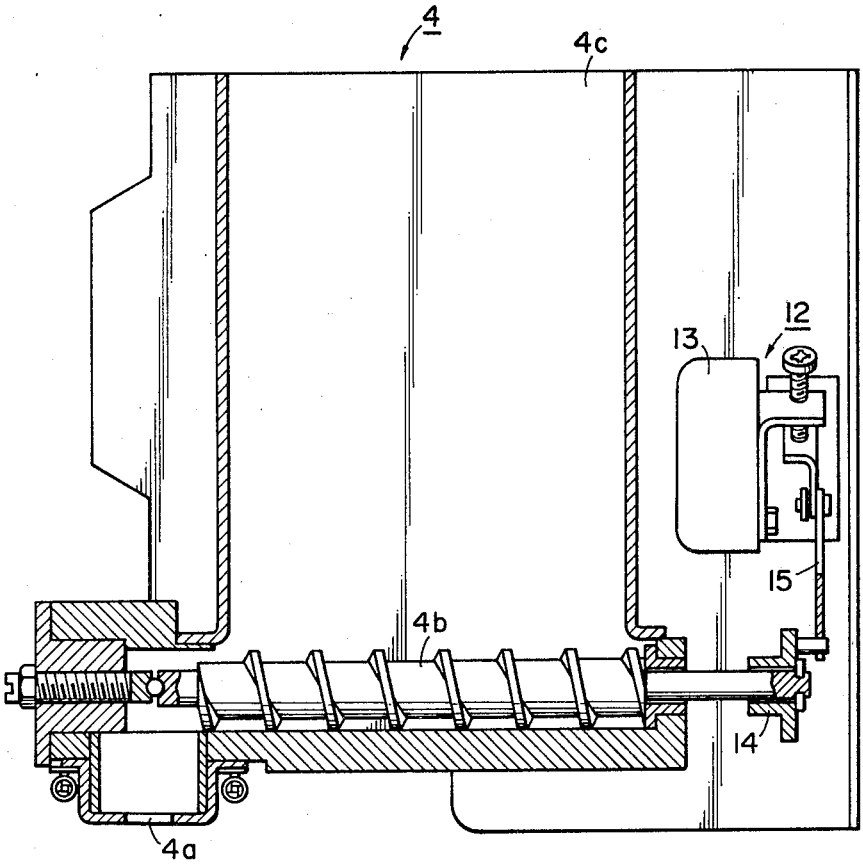
FIG. 5 is a cross-sectional view of a carrier supply device.

FIG. 3 shows in exploded perspective view a developing device 2 disposed in proximity to a drum type photosensitive medium 1, and a toner supply device 3 and a carrier supply device 4 mounted to the developing device. FIGS. 4 and 5 are enlarged cross-sectional views of the toner supply device and the carrier supply device, respectively.

Supply of toner will first be described. An example of the toner supply device is shown in FIGS. 3 and 4. This toner supply device 3 may be dismounted with respect to the developing device 2 at any time. The toner supply device 3 is provided with a feed screw 3*b* for toner supply below a hopper 3*c* (see FIG. 4). Designated by 5 is a driving mechanism for the feed screw 3*b*. This driving mechanism 5 comprises a rotary solenoid 7 or motor operable upon application thereto of a detection signal (from a volume detecting element 6 shown in FIG. 3) corresponding to a decrease in volume of developer, and a one-way clutch 8 mounted to the screw 3*b*. The drive by the rotary solenoid 7 is transmitted to the one-way clutch 8 by a connection bar 9 and intermittently rotates the screw 3*b* through the clutch. During rotation of the screw 3*b*, toner is caused to fall from a toner supply hole 3*a* and is supplied to the developing device 2 through the opening 2*a* (see FIG. 3) of the developing device 2 and mixed with carrier and stirred. Denoted by 10 is stirring means mounted on the inner side wall surface of the hopper 3*c* for rotation following the screw 3*b* and provided with a stirring piece 11 projected into the hopper. The stirring means serves to prevent bridging of the toner within the hopper.

Supply of carrier will now be described. FIG. 5 is a cross-sectional view of the carrier supply device. In FIG. 5, a value related to the density of the toner in the developer is detected (as will later be described) and the screw 4*b* of the carrier supply device is operated in accordance with a carrier supply signal produced thereby. Carrier is supplied into the opening 2*b* of the developing device 2 through a supply hole 4*a* provided in the forward end portion of the carrier supply device, and is mixed and stirred with toner by a screw 2*c* which conveys the developer in opposite directions within the developing device.

This carrier supply device may also be dismounted with respect to the developing device 2 at any time. In the carrier supply device, there is a driving mechanism 12 for a feed screw 4*b* for supplying carrier. The driving mechanism 12 comprises a rotary solenoid 13 or motor operable by the developer volume decrease signal in the developing device, and a one-way clutch 14 mounted to the screw 4*b*. The drive by the rotary solenoid 13 is transmitted to the one-way clutch 14 by a connection bar 15 and intermittently rotates the screw 4*b* through the clutch and causes carrier to fall little by little from the supply hole 4*a*, thus supplying the carrier into the developing device.

As the method of indicating the density of the toner in the developer, there are well-known methods (1)–(4) which have been shown previously. The present embodiment adopts the system whereby portions of a predetermined potential (printed portion and background portion) are developed on a latent image bearing member and after the development, the reflection density on the latent image bearing member is measured and compared with a reference value to produce a detection signal. As an example, as shown in FIG. 3, an area 16 of a potential corresponding to the printed portion or the background portion is provided on the latent image bearing member 1, and the result of having developed that portion is detected by a device 17 for measuring the optical density of toner image disposed at a predetermined location between the developing device and a cleaning device to thereby measure the image density.

Figure 6:
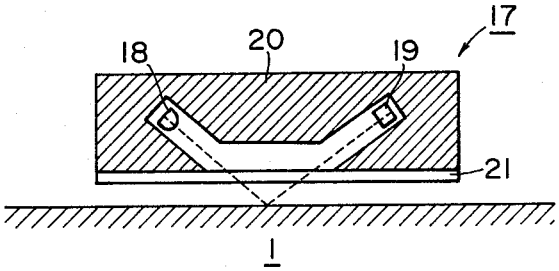
FIG. 6 is a cross-sectional view showing an embodiment of the optical density measuring device.

An embodiment of the optical density measuring device 17 is shown in FIG. 6. This device employs LED as a light source 18, and the light emitted from the LED and reflected by the drum (latent image bearing member) is received by a photodiode 19. Reference numeral 20 designates a cover, and reference numeral 21 denotes a dust-proof glass.

Also, as the method of detecting the image density, the developed image may be transferred to a transfer medium P (FIG. 3), whereafter the density of the image on the transfer medium may be measured as the reflection density by said measuring device or by another method. The apparatus may also be designed such that both the image density on the drum or the image density on the transfer medium and the density of the background portion (light portion) thereof are detected and, when the difference therebetween exceeds a predetermined value, carrier is supplied. Any change in volume of developer is detected by a level detecting element 6 provided in the developing device 2.

Figure 7:
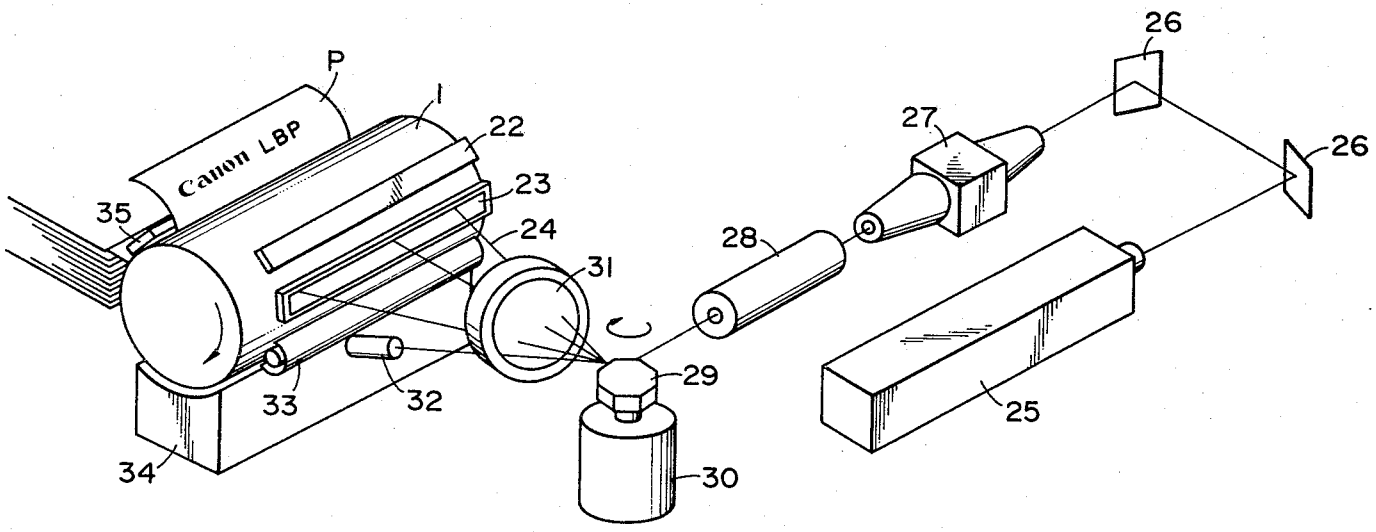
FIG. 7 shows the construction of a laser beam printer to which the present invention is applicable.

FIG. 7 schematically shows the construction of laser beam printer into which the present invention may be incorporated. In FIG. 7, a photosensitive drum basically comprising an electrically conductive layer, a photoconductive layer and a surface insulating layer is uniformly charged by a primary charger 22, and is subjected to AC discharge or corona discharge opposite in polarity to the primary charge by a secondary corona discharger 23 while, at the same time, a laser beam 24 is applied to the photosensitive drum. The laser beam 24 is oscillated from a laser oscillator 25 and directed to the input opening of a modulator 27 via a mirror 26. The mirror 26 is inserted to bend the light path and reduce the space occupied by the apparatus, and may be eliminated if unnecessary. As the modulator 27, use may be made of an acousto-optical modulation element utilizing the well-known acousto-optical effect or an electro-optical element utilizing the well-known electro-optical effect. In the modulator 27, the laser beam is subjected to intense or weak modulation in accordance with the input signal to the modulator 27.

Also, where the laser oscillator is a semiconductor laser or even a gas laser of the type which is capable of current modulation or of the internal modulation type in which a modulation element is incorporated in the oscillated light path in the laser oscillator, the modulator 27 may be eliminated and the laser beam is directly directed to a beam expander 28.

The laser beam from the modulator 27 has its beam diameter expanded by the beam expander 28 while remaining to be a parallel beam. The laser beam having had its beam diameter so expanded impinges on a rotatable polygonal mirror 29 or galvano mirror having one or more mirror surfaces. The rotatable polygonal mirror 29 is mounted on a shaft supported by a bearing of high accuracy (for example, a pneumatic bearing), and is driven by a motor 30 of constant speed rotation (such as, for example, a hysteresis synchronous motor or a DC servomotor). The laser beam 24 horizontally swept by the rotatable polygonal mirror 29 is imaged as a spot on the photosensitive drum 1 by an imaging lens 31 having f-$\theta$ characteristic through the secondary corona discharger 23. Designated by 32 is a beam detector.

After the application of the laser beam to it, the photosensitive drum 1 is subjected to whole surface exposure by a whole surface exposure lamp 33, whereby an electrostatic latent image is formed on the surface thereof. The electrostatic latent image is developed into a visible image by a developing device 34, and the visible image is transferred to transfer paper P by a transfer charger 35. The transferred visible image is fixed by a fixing device (not shown).

As the developer supply device for the developing device 34 of the above-described printer apparatus, the toner supply device and carrier supply device of the present invention can be utilized. Of course, the present invention is also applicable to copying machines or printers utilizing a magnetic latent image.

Figure 8:
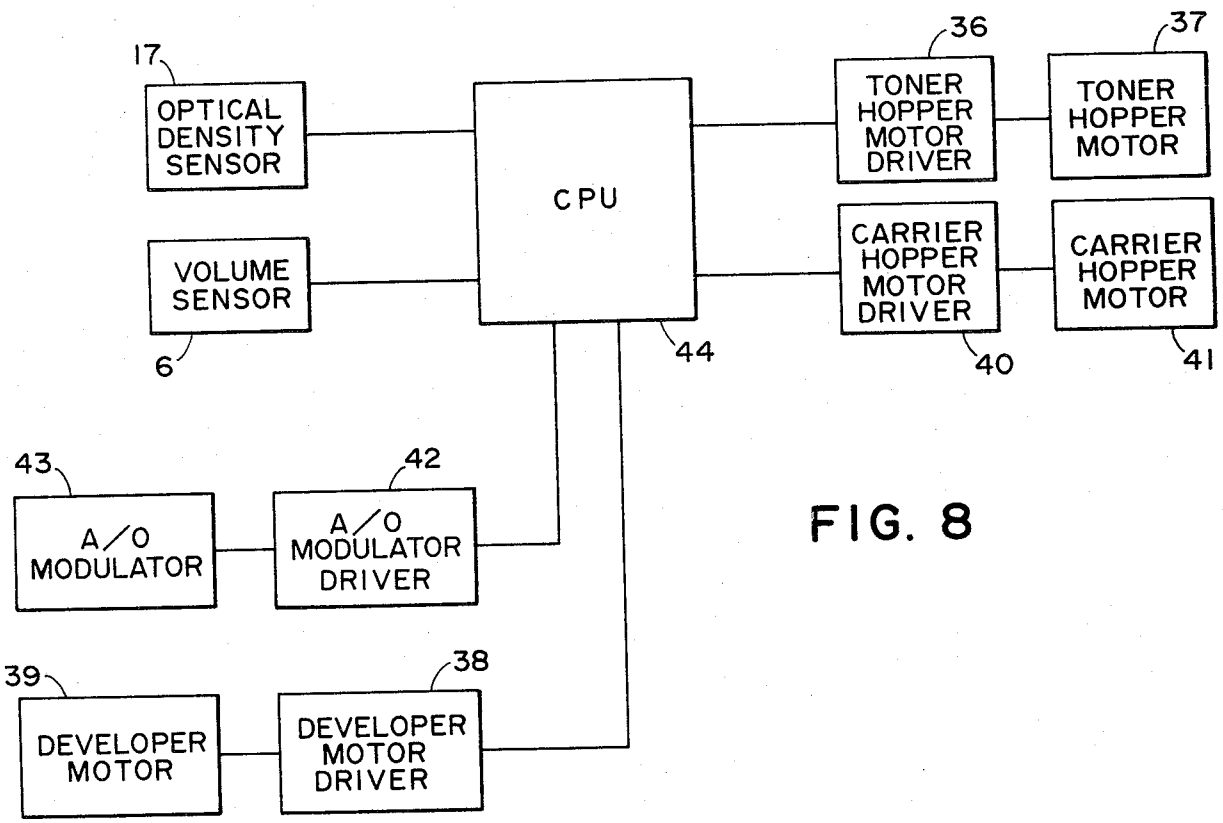
FIG. 8 is a block diagram concerning the control of the developer supply device.

Reference is now made to FIG. 8 to describe the toner and carrier supply operation in a case where the present invention is applied to a laser beam printer as described above. FIG. 8 is a block diagram concerning the control of the toner and carrier supply to the laser beam printer.

First, in the normal print mode, the volume of the developer in the developing device is always detected and when a volume sensor 6 detects any decrease in volume of the developer, the detection signal is sent to a CPU 44 and, only when the developing device operates, a toner hopper motor 37 is driven by a toner hopper motor driver 36 to rotate the screw 3*b* (FIG. 4) and this continues until the volume sensor 6 does not detect the volume decrease signal.

Further, a routine in which the presence of supply of carrier is judged is effected after the main switch is closed once a day and immediately before the first printing operation is started, or every predetermined time (10–20 hours) determined by a timer. That is, a background portion potential is set on the photosensitive drum 1 and no signal is set to a developing device motor driver 38 and a developing device motor 39 is not operated. Under such condition, the photosensitive drum 1 is rotated and the reflection density of the photosensitive drum which has not yet been developed is measured by the optical density sensor 17, and with the aid of this value, the relative value of the reflection density is memorized as 0 level. Next, by suitably modulating the laser beam, a printed portion potential is set on the area 16 of predetermined potential on the drum. By taking up the timing at which the printed portion potential area 16 has passed through the developing device to the position of the reflection density sensor 17, the reflection density of the printed portion potential area is measured to obtain the difference between it and the relative value 0 level measured previously. When this value exceeds a preset predetermined value, a signal is sent to a carrier hopper motor driver 40 to drive a carrier hopper motor 41 for a predetermined time and rotate the screw *4b*, thus supplying a predetermined amount of carrier to the developing device. Production of a signal for driving a driver 42 and modulator 43 in accordance with these sensor signals is carried out by the CPU microcomputer 44.

The effect with which the present invention is carried out will be described by reference to FIGS. 9 and 10 and a hypothetical example based on a assumed model.

| | |
|---|---|
| Conditions: | |
| Apparent density of toner (in the same filled condition as the developing device): 0.5g/cc | |
| Apparent density of carrier (in the same filled condition as the developing device): 2.6g/cc | |
| Print area ratio: 10% | |
| Toner consumption: 0.050g/A4 (0.10cc/A4) | |
| Carrier consumption: 1.0mg/A4 (0.38mcc/A4) | |
| Initial developer | |
| Toner density | 6% |
| Developer volume | 1300cc |
| Developer weight | 2700gr |
| Toner | 162gr |
| Carrier | 2538gr |
| Copying speed | 50 pages (A4)/min. |

Figure 9:
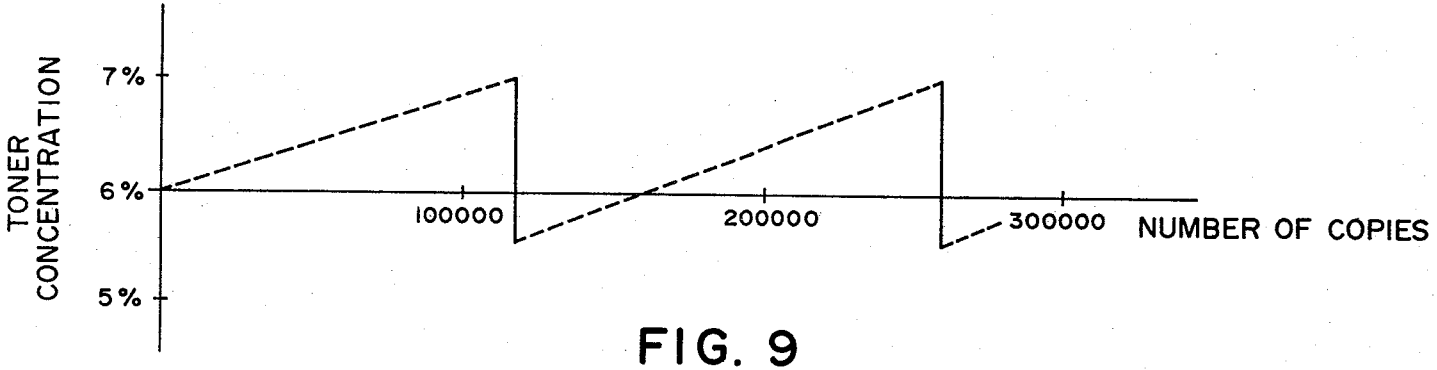
FIGS. 9 and 10 are graphs respectively showing the variation in density of the toner within developing device according to the present invention and the variation in volume of the developer within the developing device.

When toner has been supplied by the conventional developing device system so that a volume of 1300 cc is maintained, the toner density in the developer has changed from the initial 6% to 7% at a point of time whereat about 108,500 pages of A4 size recording paper have been outputted (FIG. 9). When the developing conditions are initially set to optimum, the order of 7% is a range practically allowable in view of the fog, etc. of the background.

Figure 10:
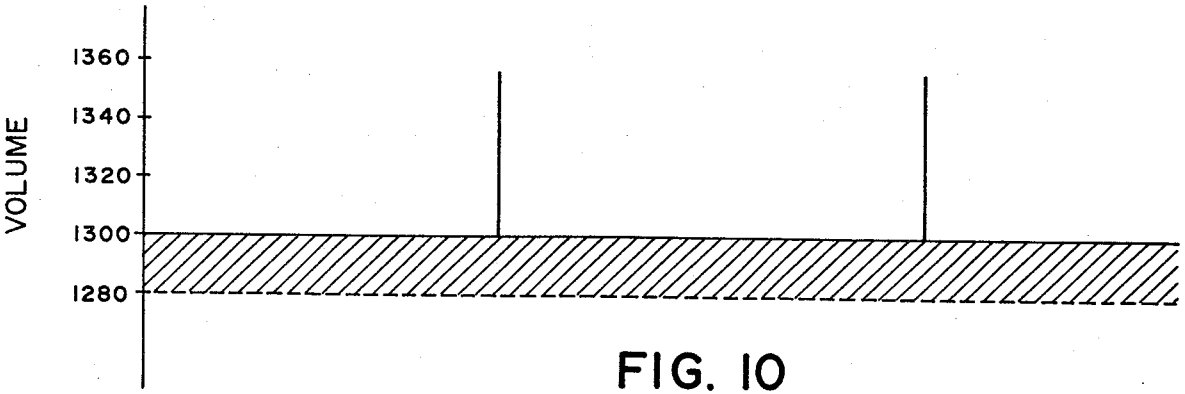

Here, in the present invention, carrier of about 150 g (58 cc) is supplied from the carrier supply device and the volume of the developer increases to 1358 cc and the toner density becomes about 6.6% (FIGS. 9 and 10). When about 580 pages have been outputted, the developer volume becomes 1300 cc and the then toner density is about 5.6%. About 150,000 pages can be outputted from this point of time until the toner density becomes 7% (FIGS. 9 and 10).

According to the volume detection system of the present developing system, volume variation can be sized in a variation within 20 cc. Accordingly, the interval at which toner is supplied to maintain the volume at 1300 cc is four minutes if about 200 pages are outputted continuously, and this means that the supply operation is effected considerably frequently. On the other hand, the interval at which carrier is supplied is every 100,000–150,000 pages or 33–50 hours which means a considerably show time interval. In this manner it is possible to maintain the toner density constant for a long period of time.

The present invention, as described above, provides a device for supplying a two-component developer for electrophotography comprising a mixture of toner and carrier in which a method of separately supplying carrier is introduced in addition to the supply of toner so that the supply of carrier is effected in accordance with the variation in image density while the supply of toner is effected in accordance with the variation in volume of the developer within the developing device corresponding to the toner consumption, and has (1) the effect that the toner density (admixture ratio of toner and carrier) can always be maintained at a predetermined value, and (2) the effect that the amount of developer in the developing device can always be maintained constant and therefore, developed images of uniform and constant image density can be obtained as compared with the conventional supply method directed chiefly to the supply of one component.

Applicant has previously proposed a device in which supply of toner and supply of carrier are effected separately from each other (Japanese Laid-open Patent Application No. 48254/1979). However, in this device, supply of toner is effected in accordance with the variation in image density and therefore, measurement of the image density must be frequently effected with the operation of the developing device stopped each time, and this leads to a disadvantage that the image formation time is shortened. The present invention is free of such disadvantage and can stably maintain the ratio of toner to carrier at a proper value for a long time.

What we claim is:

1. A developer supply device for supplying a developer consisting of toner and carrier to a developing device for developing a latent image on a latent image bearing member, said supply device comprising:

toner supply means for supplying toner to said developing device;

means for detecting any variation in volume of the developer within the developing device and for generating a detect signal indicative thereof;

means for controlling the toner supply in accordance with the detection signal of said volume detecting means;

carrier supply means for supplying carrier to said developing device;

means for detecting the image density after development and for generating a detection signal indicative thereof; and means for controlling the carrier supply means in accordance with the detection signal of said density detecting means.

2. A device according to claim 1, wherein said image density detecting means is optical detector means.

3. A device according to claim 2, wherein said optical detector means detects the image density on the latent image bearing member.

4. A device according to claim 2, wherein said optical detector means detects the image density on a transfer medium to which the image after being developed has been transferred.

5. A developer supply device for supplying a developer consisting of toner and carrier to a developing device for developing a latent image on a latent image bearing member, said supply device comprising:

toner supply means for supplying toner to said developing device;

means for detecting any variation in volume of the developer within the developing device and for a generating a detection signal indicate thereof;

means for controlling the toner supply in accordance with the detection signal of said volume detecting means;

carrier supply means for supplying carrier to said developing device;

means comprising optical detector means for detecting the image density after development and for generating a detection signal indicative thereof; and means for controlling the carrier supply means in accordance with the detection signal of said density detecting means, wherein said optical detector means detects the image density on the latent image bearing member or on a transfer medium and the density of the background thereof, and said carrier supply control means controls said carrier supply means to supply carrier when the difference between the detection signals of said optical detector means exceeds a predetermined value.

6. A device according to claim 1, wherein said toner supply control means controls the toner supply so that the volume of the developer within the developing device is constant.

7. A device according to claim 1, wherein said toner supply control means controls said toner supply means to effect toner supply when the volume of the developer within the developing device is below a predetermined value.

8. A device according to claim 1, wherein said carrier supply control means controls said carrier supply means to effect carrier supply when the density of the toner in the developer exceeds a predetermined value.

9. A developer supply device for supplying a developer consisting of toner and carrier to a developing device for developing a latent image on a latent image bearing member, said supply device comprising:

toner supply means for supplying toner to said developing device;

carrier supply means for supplying carrier to said developing device;

means for detecting any variation in amount of the developer within the developing device and for generating a detection signal indicative thereof;

means for detecting the image density after development and for generating a detection signal indicative thereof; and concentration control means for controlling the supplies of toner and carrier in response to the signals from said two detecting means.

10. An electrophotographic apparatus having:

a latent image bearing member having at least a photoconductive layer;

means for forming an electrostatic latent image on said latent image bearing member by application of a laser beam thereto; means for developing the electrostatic latent image;

a developer supply device for supplying a developer consisting of toner and carrier to said developing means, said supply device comprising:

toner supply means for supplying toner to said developing means;

means for detecting any variation in volume of the developer within the developing means and for generating a detection signal indicative thereof;

means for controlling the toner supply in accordance with the detection signal of said volume detecting means;

carrier supply means for supplying carrier to said developing means;

means for detecting the image density after development; and means for controlling the carrier supply in accordance with the detection signal of said density detecting means.

* * * * *